US005465452A

United States Patent [19]

Girardot et al.

[11] Patent Number: 5,465,452

[45] Date of Patent: Nov. 14, 1995

[54] IMPLEMENT FOR PERSONAL CLEANSING MADE FROM EXTRUDED PLASTIC SCRIM

[75] Inventors: Richard M. Girardot; Eric J. Grosgogeat; Charles G. Yeazell; Richard G. Bausch, all of Cincinnati, Ohio

[73] Assignee: The Procter & Gamble Company, Cincinnati, Ohio

[21] Appl. No.: 221,428

[22] Filed: Mar. 31, 1994

[51] Int. Cl.[6] ..... A47L 13/07; A46D 3/00

[52] U.S. Cl. ..... 15/210.1; 15/209.1; 15/229.11; 300/21

[58] Field of Search ..... 15/209.1, 210.1, 15/229.11, 229.12, 208, 223, 225, 222; 29/419.1; 300/21

[56] References Cited

U.S. PATENT DOCUMENTS

| | | | |
|---|---|---|---|
| 1,533,868 | 4/1925 | Kingman | 15/229.11 |
| 1,659,977 | 2/1928 | Kingman | 15/208 |
| 1,689,207 | 10/1928 | Kingman | 15/229.11 |
| 1,794,854 | 3/1931 | Kean | 15/229.11 |
| 1,865,785 | 7/1932 | Parker | 15/209.1 |
| 1,963,529 | 6/1934 | Protz | 15/208 |
| 2,151,448 | 3/1939 | Steinberg | 15/208 |
| 2,601,771 | 7/1952 | Cameron | 15/229.11 |
| 2,857,610 | 10/1958 | Rympalski | 15/229.11 |
| 2,940,100 | 6/1960 | Grossmeyer | 15/118 |
| 3,169,264 | 2/1965 | Walker | 15/118 |
| 3,241,171 | 4/1966 | Benjamin et al. | 15/118 |
| 3,711,889 | 1/1973 | Jennings | 15/227 |
| 3,772,728 | 11/1973 | Johnson | 15/209 R |
| 3,778,172 | 12/1973 | Myren | 401/7 |
| 3,977,452 | 8/1976 | Wright | 15/209.1 |
| 4,144,612 | 3/1979 | Yamaguchi | 15/208 |
| 4,154,542 | 5/1979 | Rasmason | 401/7 |
| 4,168,863 | 9/1979 | Hatcher | 15/229.11 |
| 4,196,490 | 4/1980 | Jonzon | 15/222 |
| 4,206,948 | 6/1980 | Shimizu | 300/21 |
| 4,343,061 | 8/1982 | Hanazono | 15/244 B |
| 4,457,640 | 7/1984 | Anderson | 401/7 |
| 4,462,135 | 7/1984 | Sanford | 15/105 |
| 4,473,611 | 9/1984 | Haq | 15/118 |
| 4,769,022 | 9/1988 | Chang et al. | 604/368 |
| 4,893,371 | 1/1990 | Hartmann | 15/209 B |
| 4,948,585 | 8/1990 | Schlein | 424/40 |
| 4,969,226 | 11/1990 | Seville | 15/244.4 |
| 4,986,681 | 1/1991 | Oliver | 401/7 |
| 4,993,099 | 2/1991 | Emura et al. | 15/118 |
| 5,144,744 | 9/1992 | Campagnoli | 29/446 |
| 5,187,830 | 2/1993 | Giallourakis | 15/244.3 |

FOREIGN PATENT DOCUMENTS

| | | |
|---|---|---|
| 023748 | 12/1992 | European Pat. Off. . |
| 1473147 | 9/1974 | United Kingdom . |

*Primary Examiner*—Gary K. Graham

*Attorney, Agent, or Firm*—Ronald W. Kock; Michael E. Hilton

[57] ABSTRACT

An extruded scrim having a diamond-mesh pattern is used to construct a personal cleansing implement. The diamond-mesh material is produced from a hydrophobic flexible polymer. The implement comprises a piece of tubular scrim having a longitudinal axis. The tubular scrim is stretched transversely to the longitudinal axis and is gathered parallel to the longitudinal axis to form circumferential pleats. In one embodiment the stretched and gathered tubular scrim is heat set in its expanded and pleated condition. A second piece of tubular scrim is placed inside the pleated and expanded scrim tubing. One end of the second piece is inverted over the outside of the pleats and connected to the other end to envelop the pleated and expanded scrim tubing. In another embodiment the pleats are not heat set and remain resilient. This embodiment has a means for confining the circumferential pleats from axial expansion. A band of material is looped through the scrim tubing and around its outer surface. Pleats are then evenly distributed around the loop to form a toroidal shaped implement. The personal cleansing implement of the present invention has a high open area, without a dense center core to inhibit rinsing and drying.

7 Claims, 3 Drawing Sheets

IMPLEMENT FOR PERSONAL CLEANSING MADE FROM EXTRUDED PLASTIC SCRIM

FIELD OF THE INVENTION

The present invention relates to hand held implements used for personal cleansing, and more particularly to such implements made from hydrophobic diamond-mesh polymers.

BACKGROUND OF THE INVENTION

A variety of cleansing implements have been used to remove dirt and dead skin from the user's body during bathing or showering. Traditionally, hand held terry washcloths and natural and synthetic sponges have been used. Each of these has one or more significant deficiencies. For example, a sponge has pores which make it difficult to remove dirt from the implement once the dirt is transferred from the body. A washcloth often impedes lathering even though lathering is a primary function of a cleansing implement. Neither sponges nor washcloths can be dried quickly because they become water-logged. As a result they develop unpleasant odors and become a place for breeding bacteria, mold, etc.

More recently, ball-like structures made of polymer netting have been found in the prior art. An example is disclosed in U.S. Pat. No. 5,144,744 to Campagnoli, issued Sep. 8, 1992. This implement is made of diamond-mesh polyethylene. Diamond-mesh polyethylene is an extruded scrim material which is commonly found covering vegetables, meat, and poultry. The implement of Campagnoli is made by stretching multiple tubular pieces of diamond-mesh scrim transversely to their tubular axes and placing each piece over separate support posts. The supported pieces, held in a stretched condition, are arranged either parallel to or at different angles to each other. By tying together the stretched pieces at their centers, and then releasing the pieces from their support posts, each piece springs back toward the tied center to generate a ball-like shape. Commercially available implements of this type are sold by The Body Shop of London, England; and by Bilange of New York, N.Y.

Prior art structures similar to Campagnoli's have the stretched pieces of gathered diamond-mesh scrim cinched at their centers to produce hard dense cores, which hinder rinsing and drying. Campagnoli's structure is therefore difficult to rinse and dry for sanitary reuse.

SUMMARY OF THE INVENTION

In constructing the personal cleansing implement of the present invention, an extruded scrim having a diamond-mesh pattern is used. The diamond-mesh material is typically produced in tubular form from a hydrophobic flexible polymer.

In one preferred embodiment of the present invention a personal cleansing implement comprises a first piece of tubular scrim having a longitudinal axis, the first piece of tubular scrim having been stretched transversely to the longitudinal axis and gathered parallel to the longitudinal axis to form circumferential pleats. The first piece of tubular scrim has a center opening and an outer surface. A means for confining the resilient circumferential pleats from axial expansion passes through the center opening and around the outer surface of the first piece of tubular scrim. The confining means has a first end and a second end that are connected together. The personal cleansing implement has a high open area without a dense center core to inhibit rinsing and drying. It may also have hanging means connected to the means for confining the circumferential pleats. In this embodiment the confining means comprises a band of hydrophobic material located in a plane substantially parallel to the longitudinal axis of the first piece of tubular scrim. The first and second ends of the band are connected to form a loop. The circumferential pleats are distributed substantially evenly around the loop. The result is an implement which is soft, yet resilient, so that it may be conveniently gripped and rubbed against dry skin without abrasion. Because it is made of hydrophobic material and it has a high open area throughout, it may be thoroughly rinsed and quickly dried for reuse.

In another preferred embodiment of the present invention, the personal cleansing implement has a first piece of stretched and gathered tubular scrim as in the first embodiment, except that the pleats are heat set rather than resilient. Instead of a band of material confining the pleats, a second piece of tubular scrim passes through the center opening in the first piece. The first end of the second piece of tubular scrim is stretched around the pleats until it is fully inverted over the outer surface of the first piece. The first end of the second piece of tubular scrim is then cinched to the second end of the second piece in order to envelop the first piece of tubular scrim. The personal cleansing implement has a high open area without a dense center core to inhibit rinsing and drying. It may also have hanging means connected to the means for confining the circumferential pleats.

In still another preferred embodiment of the present invention, the personal cleansing implement is constructed by a method comprising the steps of cutting a piece of tubular scrim from a source thereof. The piece of tubular scrim has an outer surface. Transversely stretching the piece of tubular scrim over a mandrel is another step. Additional steps include gathering the piece of tubular scrim on the mandrel to form circumferential pleats, and placing a cinching member between the piece of tubular scrim and the mandrel and around the outer surface of the piece of tubular scrim. Further steps include cinching the pleats together loosely, removing the piece of tubular scrim from the mandrel, and distributing the pleats substantially evenly around the cinching member.

In yet another preferred embodiment of the present invention, the personal cleansing implement is constructed by a method comprising the step of cutting first and second pieces of tubular scrim from a source thereof. The first piece has a center opening and an outer surface. Another step comprises stretching the first piece of tubular scrim transversely by placing it onto a mandrel. Additional steps include gathering the first piece of tubular scrim on the mandrel to form circumferential pleats in the first piece of tubular scrim, and exposing the first piece of tubular scrim and the mandrel to sufficient heat to heat set the first piece of tubular scrim in a stretched and pleated condition. Further steps include removing the mandrel from the first piece of tubular scrim to expose the center opening therein, and placing the second piece of tubular scrim through the center opening in the first piece of tubular scrim. The second piece has a first end and a second end. Finally, the method includes steps of transversely stretching the first end of the second piece of tubular scrim larger than the pleats of the first piece of tubular scrim, inverting the first end of the second piece over the circumferential pleats of the first piece of tubular scrim, and cinching the first end of the second piece to the second end of the second piece with a cinching member in order to enclose the first piece of pleated tubular scrim therein.

In this and other embodiments there may also be a further step of tying a tether through the cinching member so that the personal cleansing implement may be hung from a support for drying.

In still another preferred embodiment of the present invention, the personal cleansing implement comprises diamond-mesh scrim expanded and heat set to form a permanently expanded scrim having a high open area. The expanded scrim is gathered in such a way that a three-dimensional structure is formed. This embodiment also comprises a means for containing the three-dimensional structure. The containing means is cinched closed by a cinching means. The cinching means cinches a minimum volume of the containing means so that the personal cleansing implement has a maximum of high open area throughout. The containing means comprises a piece of tubular scrim having a first end and a second end. The first end is stretched around the three-dimensional structure and inverted toward the second end and cinched to the second end.

Alternatives for the way in which the three-dimensional structure is gathered include: uniformly folding the permanently expanded scrim into a stack of layers to form a batt, forming a piece of tubing and gathering it to form circumferential pleats before the diamond-mesh scrim is heat set, and randomly crumpling the expanded diamond-mesh scrim to form a ball-like structure.

Alternatives for cinching the containing means closed include: a band of hydrophobic material having an interlocking surface and a means for engaging the interlocking surface, so that when the band is pulled tightly around material to be cinched, the means for engaging the interlocking surface engages the interlocking surface and prevents the band from loosening; and thermobonding.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

FIG. 8 is a side elevation view thereof, showing the implement to have a flattened ball-like shape, with a tether connected there to;

DETAILED DESCRIPTION OF THE INVENTION

Figure 1:
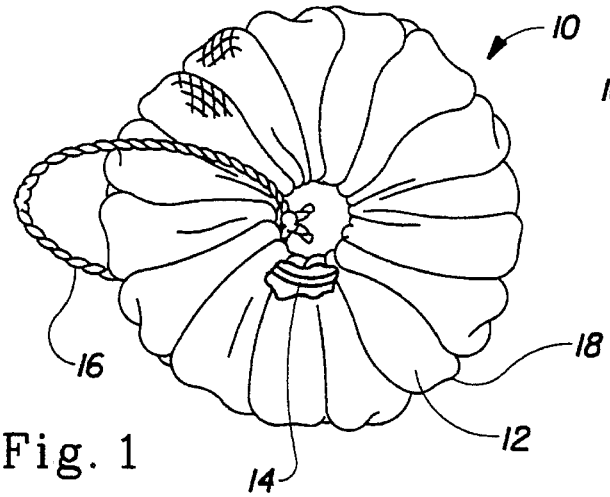
FIG. 1 is a top plan view of a preferred embodiment of the implement for personal cleansing of the present invention, disclosing a diamond-mesh tubular scrim member, which is pleated about a cinching means, and has a tether connected thereto.
Figure 2:
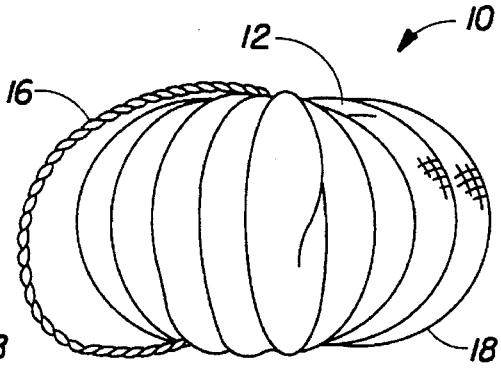
FIG. 2 is a side elevation view thereof, showing the implement to have a toroidal shape.

Referring now to the drawings, and more particularly to FIGS. 1 and 2, there is shown a first preferred embodiment of the present invention, which provides a personal cleansing implement, which is generally indicated as 10. The implement 10 has three components: a piece of tubular scrim 12, having a diamond-mesh pattern; a band of material forming a loop 14; and a tether 16. Commercial diamond-mesh scrim 12 is extruded, chilled and rolled onto spools for storage, shipping, and handling. Alternatively, the diamond-mesh scrim could be formed and fed directly to an implement assembly process. Diamond-mesh tubular scrim stock is commercially available from NSW Corporation of Roanoke, Va.

In a particularly preferred embodiment diamond-mesh scrim tubing has a specification number SPR 387, and is described as polyethylene facial mesh having a density of 3.0 grams per foot. When personal cleansing implements are made, such material is cut to desired lengths for assembly. In the present invention a cut length of about 9 feet (274 cm) of hydrophobic, diamond-mesh tubular scrim is transversely stretched and gathered on a mandrel to form circumferential pleats 18. While gathered on the mandrel, a band of material is placed between the mandrel and pleats 18 and then tied around the outer surface of the pleated tubular scrim to form a closed loop 14. Closed loop 14 is about one inch (2.5 cm) in diameter. In an automated assembly system, the band of material could be placed in a groove in the mandrel prior to stretching the tubular scrim over the mandrel.

When the piece of scrim 12 and the loop 14 are removed from the mandrel, the pleats are manually distributed as evenly as possible around the loop 14 as shown in FIG. 1. The band of material that forms loop 14 is preferably made of a hydrophobic material such as nylon twine. The closed loop 14 is formed by tying a knot in the twine. Alternatively, the twine could be made of cotton, which is not hydrophobic. Since the volume of such twine is so small, it will dry quickly even though it is not hydrophobic. Tether 16 is also preferably hydrophobic material, such as braided rope made of polypropylene. The preferred rope is commercially available from Maxi-Cord of Chicago, Ill. It has a specification number W-01, and it is 3.5 mm in diameter. Tether 16 is tied through loop 14 and forms a larger closed loop for the purpose of hanging the implement 10 after use so that it will air dry quickly. Alternatively, loop 14 and tether 16 could be the same piece of hydrophobic material tied into a figure-8, in order to serve as both the means for confining the pleats and as the tether.

Because implement 10 has a high open area, implement 10 helps to generate a significant amount of lather when used with a liquid, gel, or solid form of skin cleanser. The implement is held in one hand. Cleanser is preferably added to the implement rather than to the skin. The cleanser is then rubbed against the skin by the implement in the presence of water, lifting dirt and exfoliated skin into the implement. It is believed that lathering enhances the removal of dirt and exfoliated skin from the surface of the body. Implement 10 enables substantially more lather and better consistency lather to be developed than is generally possible with a washcloth or sponge. Once bathing or showering are completed, implement 10 may be thoroughly rinsed and quickly dried, thereby avoiding the slow drying of washclothes or sponges. The construction of implement 10 has pleats loosely confined within loop 14. It has no hard, dense core, in contrast to implements similar to Campagnoli's, where a significant volume of the device is cinched together at the center of the implement. The structure of implement 10 is therefore believed to be more sanitary than prior art personal cleansing implements.

Figure 3:
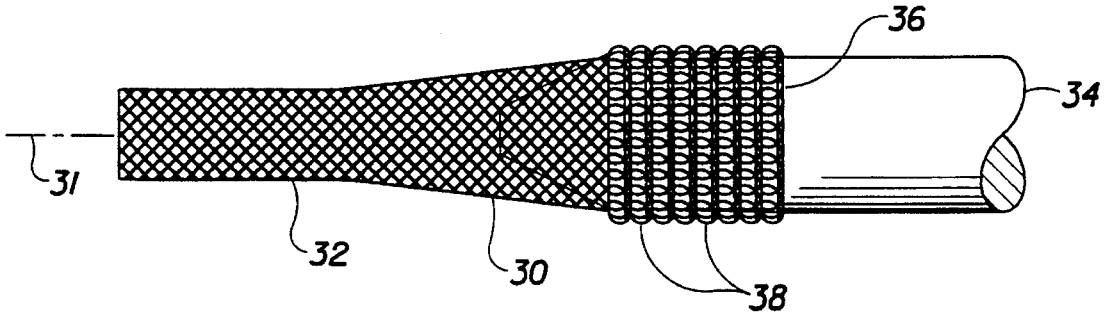
FIG. 3 is a front elevation view of another preferred embodiment of the present invention, disclosing a piece of diamond-mesh tubular scrim partially pulled onto a cylindrical mandrel, the scrim being stretched transversely and gathered to form pleats.

FIGS. 3–6 show a preferred method for constructing implement 10. FIG. 3 shows a piece of diamond-mesh polyethylene scrim tubing 30, which initially has an unstretched condition 32 of about 1.0 inch (2.5 cm) diameter and a longitudinal axis 31. Tubing 30 is pulled over the tapered nose of a cylindrical mandrel 34. Mandrel 34 has a diameter of about 2.5 inch (6.3 cm), in order to elastically stretch the tubing transverse to longitudinal axis 31. The result of elastic stretching is that diamond-mesh tubing 30 is transformed to transversely stretched scrim tubing 36. Scrim tubing 36 is gathered along longitudinal axis 31 to form circumferential pleats 38.

Figure 4:
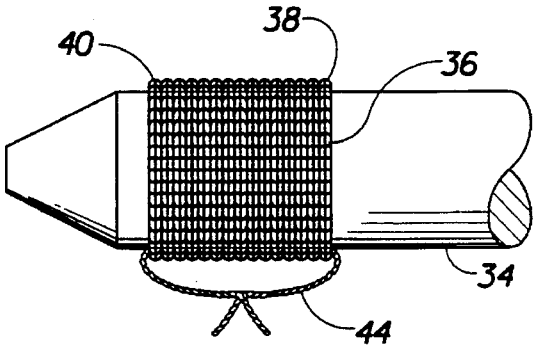
FIG. 4 is a front elevation view thereof showing the entire piece of tubular scrim gathered on the mandrel and a loop of material tied through the tubing and around the gathered pleats.
Figure 5:
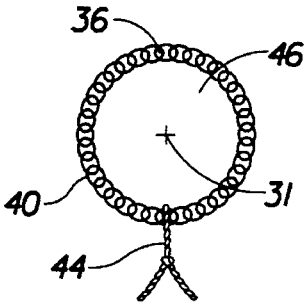
FIG. 5 is a right side elevation view thereof showing the mandrel removed from the gathered tubular scrim.

FIG. 4 shows mandrel 34 and stretched scrim tubing 36 with pleats 38. Pleats 38 have outer surface 40. Twine placed between mandrel 34 and stretched scrim tubing 36 is tied around outer surface 40 of pleats 38 to form a closed loop 44. When mandrel 34 is removed, as shown in FIG. 5, stretched scrim tubing 36 contracts somewhat because it has not been heat set in the stretched condition. However, mechanical entanglement of adjacent pleats 38 is believed to maintain some transverse stretch in scrim tubing 36. Mandrel 34 functions primarily as a tool for gathering and supporting tubular scrim 36 while loop 44 is formed. It is possible to construct implement 10, without stretching tubular scrim 30 over a mandrel. Instead, one's fingers may be used as the mandrel.

Figure 6:
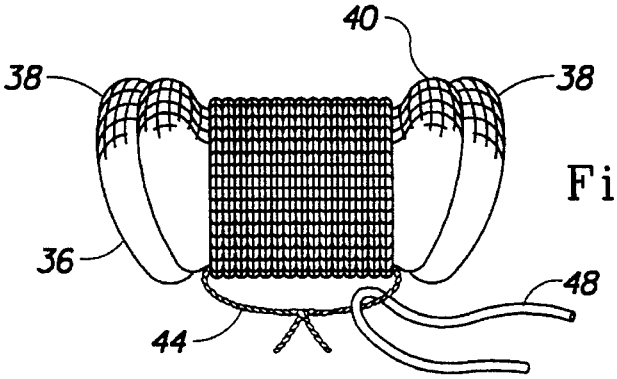
FIG. 6 is a front elevation view thereof showing the pleats of the tubular scrim member being distributed about the loop of material.

Once mandrel 34 is removed, a center opening 46 is visible in scrim tubing 36, centered around longitudinal axis 3 1. FIG. 6 shows that pleats 38 of scrim tubing 36 are distributed around loop 44. A piece of rope 48 may be passed through loop 44 before pleats are fully distributed around loop 44 so that rope 48 may be tied to form a tether for supporting implement 10. Loop 44 in FIG. 6 is the same as loop 14 in FIG. 1.

Figure 7:
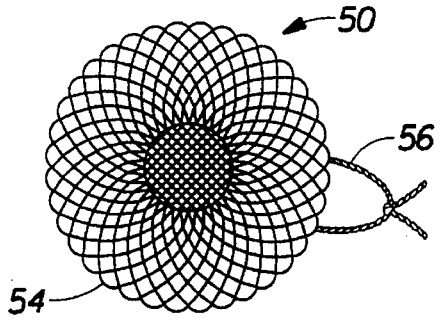
FIG. 7 is a top plan view of another preferred embodiment of the implement for personal cleansing of the present invention, disclosing a first diamond-mesh tubular scrim member, which is pleated and enveloped by a second diamond-mesh tubular scrim member.
Figure 8:
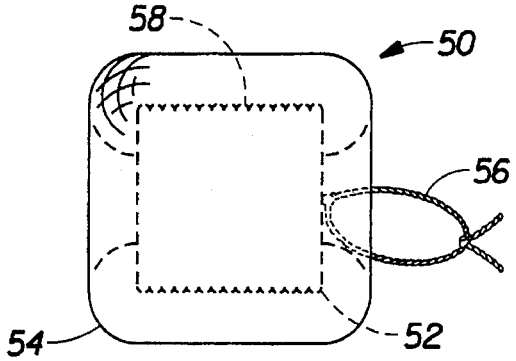

FIGS. 7 and 8 show another preferred embodiment of the present invention which provides a personal cleansing implement, which is generally indicated as 50. The implement 50 has four components: a first piece of tubular scrim 52, having a diamond-mesh pattern; a second piece of tubular scrim 54, having a diamond-mesh pattern; a cinching means not visible in FIGS. 7 and 8, but shown in FIG. 13; and a tether 56.

Commercial diamond-mesh scrim is extruded, chilled and rolled onto spools for storage, shipping, and handling. Alternatively, the diamond-mesh scrim could be formed and fed directly to an implement assembly process. When personal cleansing implements are made, such material is unwound and cut to desired lengths for assembly. In this particular embodiment of the present invention a cut length of about 11 feet (335 cm) of hydrophobic polyethylene, diamond-mesh tubular scrim 52 is transversely stretched and gathered on a mandrel to form circumferential pleats 58. While gathered on the mandrel, tubular scrim 52 is placed in an oven to heat set the piece of tubular scrim in a pleated and expanded condition. When the first piece of scrim 52 is removed from the mandrel and the oven, it does not contract transversely or expand axially. It is instead a hollow pleated cylinder of expanded diamond-mesh scrim. In this condition first piece of scrim 52 forms a three-dimensional structure which provides the bulk of implement 50.

The benefit of scrim expansion is that less material is needed per unit volume of implement. Less material per unit volume provides quicker drying and lower material cost. Alternatively, the diamond-mesh scrim could be stretched and heat set when formed and then provided in an expanded condition for implement assembly. However, it would not be pleated if stetched and then wound onto spools for shipping and handling. Pleating, which is preferably heat set into the scrim tubing, provides increased loft and resilience to the expanded scrim.

Second piece of tubular scrim 54, also preferably cut from the same source as first piece 52, to a length of about 14 inches (36 cm), is inserted inside the expanded first piece of tubular scrim. Second piece of scrim 54 is not expanded and heat set. It is instead soft and resilient. Similar to loop 14 of implement 10, second piece of scrim 54 serves as a means for confining the pleats of first piece of scrim 52. One end of second piece 54 is stretched and inverted around pleats 58 of first piece 52 and then gathered at the opposite end of first piece 52 overlapping the other end of second piece 54, thereby enveloping first piece 52 in a diamond-mesh scrim bag to form ball-like implement 50. The two ends of second piece of tubular scrim 54 are cinched together as a means for confining first piece of tubular scrim 52 within the bag. Then about 5 inches (13 cm) of cinched piece of tubular scrim 54 is trimmed off the bag near the cinch point to minimize the volume of cinched material. Tether 56 is also connected to implement 50 by the same cinching means.

Alternatively, second piece of scrim 54 may be made of a different scrim material than first piece 52 in order to provide a softer outer surface to implement 50. In a particularly preferred embodiment of implement 50, first piece of tubular scrim 52 is made by NSW Corporation of Roanoke, Va. It has specification number PT 589-01, and is described as body mesh having a density of 2.3 grams per foot. Second piece of tubular scrim 54 is made by Masternet, Ltd., of Ontario, Canada. It has specification number BRIO W-3. Second piece 54 is just being developed. It is preferred because it has a very soft texture. In general, the softer the scrim texture, the lower the scrim strength. Therefore, two or more concentric pieces of scrim tubing may form second piece 54 in order to increase the durability of the outer surface of implement 50 when the softer textured scrim is used.

The cinching means is preferably a hydrophobic material such as nylon twine, which is wrapped tightly around both overlapping ends of piece of tubular scrim 54 and tied in a knot. Tether 56 is also preferably hydrophobic material, such as nylon rope. Tether 56 forms a closed loop for the purpose of hanging the implement 50 after use so that it will air dry quickly. Alternatively, the cinching means and tether 56 could be the same piece of hydrophobic material tied as a figure-8, in order to cinch the ends of second piece of scrim 54 as well as to serve as the tether.

Similar to implement 10, implement 50 has a high open area. Thus, implement 50 helps to generate a significant amount of lather when used with a liquid, gel, or solid form of skin cleanser. The implement is held in one hand. Cleanser is preferably added to the implement rather than to the skin. The end of implement 50 opposite the cinched end is normally used as the body contact surface. As seen from FIG. 7, there is a depression in the center of the body contact surface which leads to the cinch point at the opposite end of the implement. This depression ideally serves as a target for pouring cleanser into the implement. The cleanser is then rubbed against the skin by the implement in the presence of water, lifting dirt and exfoliated skin into the implement. It is believed that lathering enhances the removal of dirt and exfoliated skin from the surface of the body. Implement 50 enables substantially more lather and better consistency lather to be developed than is generally possible with a washcloth or sponge.

Once bathing or showering are completed, implement 50 may be thoroughly rinsed and quickly dried, thereby avoiding the slow drying of washclothes or sponges. The construction of implement 50 has no hard dense core, in contrast to implements similar to Campagnoli's, where a significant volume of ! the device is cinched together at the center of the implement. Instead, only two layers of the second piece of scrim 54 are cinched together. The central part of implement 50, expanded scrim 52, is loosely contained within the bag formed by second piece of scrim 54. The structure of implement 50 is therefore believed to be more sanitary than prior art personal cleansing implements.

Figure 9:
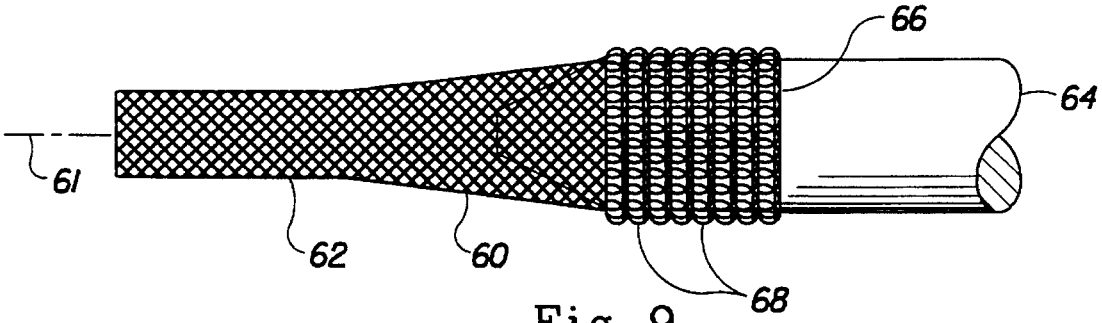
FIG. 9 is a front elevation view of another preferred embodiment of the present invention, disclosing a first piece of diamond-mesh tubular scrim partially pulled onto a cylindrical mandrel, the scrim being stretched transversely and gathered to form pleats.

FIGS. 9–13 show a preferred method for constructing implement 50. FIG. 9 shows a piece of diamond-mesh polyethylene scrim tubing 60, which initially has an unstretched condition 62 of about 1.0 inch (2.5 cm) diameter and a longitudinal axis 61. Tubing 60 is pulled over the tapered nose of a cylindrical mandrel 64, mandrel 64 having a diameter of about 5.5 inches (14 cm), in order to elastically stretch the tubing transverse to longitudinal axis 61. The result of elastic stretching is that diamond-mesh tubing 60 is transformed into transversely stretched scrim tubing 66. The scrim tubing 66 is gathered along longitudinal axis 61 to form circumferential pleats 68 in stretched scrim tubing 66.

Figure 10:
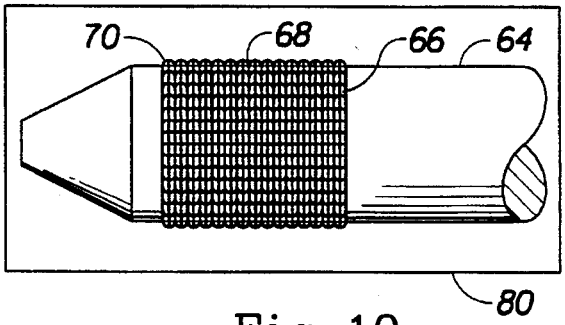
FIG. 10 is a front elevation view thereof, showing the entire first piece of tubular scrim gathered on the mandrel and placed in an oven, where it is heat set.
Figure 11:
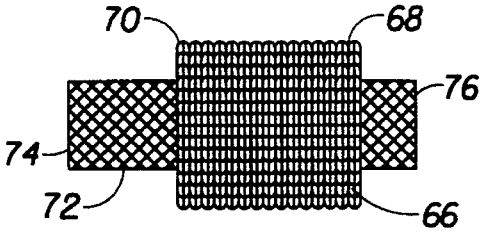
FIG. 11 is a front elevation view thereof, showing the heat set first piece of tubular scrim removed from the oven and the mandrel removed from tubular scrim, and a second unstretched piece of tubular scrim placed inside the heat set first piece of tubular scrim.

FIG. 10 shows mandrel 64 and stretched tubing 66 with pleats 68. Pleats 68 have outer surface 70. Mandrel 64 and stretched, pleated tubing 66 are placed in an oven 80 for about 10 minutes at 140° F. The Mandrel is supported in oven 80 by a support not shown so that pleats 68 are not disturbed during heating. The result of heating the first piece of tubular scrim 66 to its softening temperature is that the transverse stretch is transformed into a permanent heat set condition. Also, pleats 68 are heat set to hold their form as well. After mandrel 64 is removed, as shown in FIG. 11, a second piece of scrim tubing 72, not subject to heat setting, is inserted into a center opening of first piece of expanded scrim tubing 66, from which the mandrel was just removed. Second piece of diamond-mesh tubular scrim 72 has a first end 74 and a second end 76.

Figure 12:
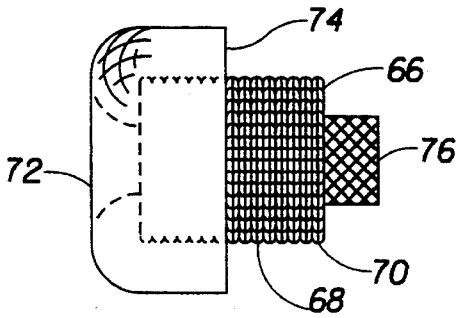
FIG. 12 is a front elevation view thereof, showing the second piece of tubular scrim being stretched and inverted over the pleats of the first piece of tubular scrim.
Figure 13:
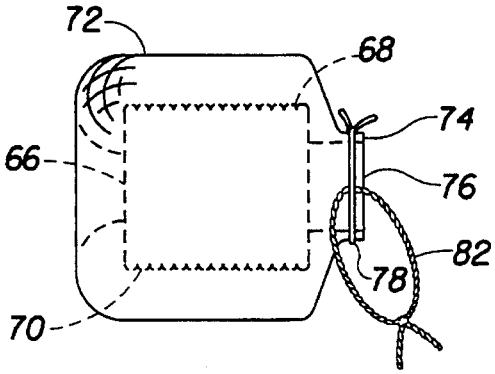
FIG. 13 is a front elevation view thereof, showing the second piece of tubular scrim fully enveloping the first piece and the two ends of the second piece being cinched together along with a tether cord by a piece of twine.

FIG. 12 shows first end 74 of second piece of scrim tubing 72 being stretched and partially inverted over outer surface 70 of pleats 68. FIG. 13 shows first end 74 fully inverted over outer surface 70 of pleats 68 and gathered to overlap second end 76 of second piece 72. A means for cinching 78 cinches overlapping ends 74 and 76 of second piece of scrim tubing 72. A piece of rope 82 is also preferably cinched by cinching means 78 to become a tether for supporting the resulting personal cleansing implement.

FIGS. 7 and 8 represent the assembled embodiment, whereas FIGS. 9–13 represent the steps in assembling the same embodiment. For example, FIG. 13 shows cinching means 78 before it is tightened and FIG. 8 shows the shape of the implement after the cinching means has been tightened.

FIGS. 14–17 show alternative embodiments for personal cleansing implement of the present invention. Different cinching means are also illustrated with different alternative embodiments. The cinching means shown for one embodiment may be used for another embodiment.

Figure 14:
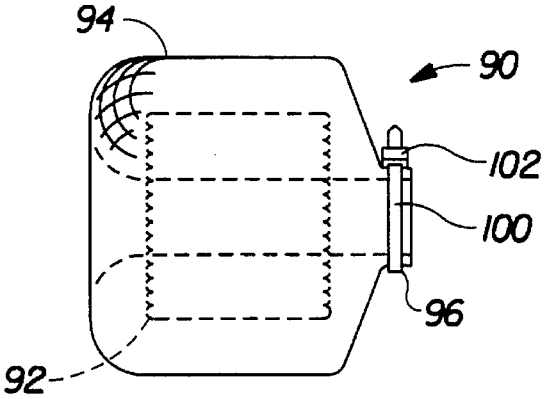
FIG. 14 is a front elevation view of another preferred embodiment of the present invention, disclosing a personal cleansing implement similar to that of FIG. 7, except that the first piece of scrim is folded rather than pleated, and the ends of the second piece of tubular scrim are cinched by a band of material having an interlocking surface and a means for engaging the interlocking surface.
Figure 15:
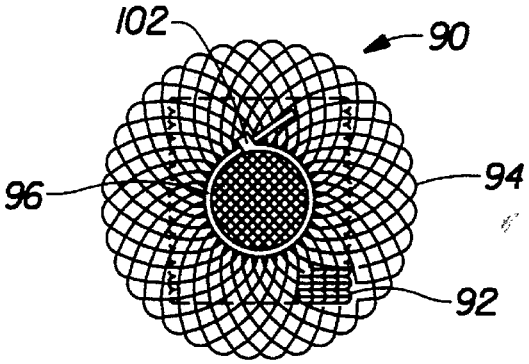
FIG. 15 is a right side elevation view thereof, showing the second piece of tubular scrim passing through folds of the first piece of scrim, as well as around the three-dimensional folded structure.

FIGS. 14 and 15 show another preferred embodiment of the present invention which provides a personal cleansing implement, which is generally indicated as 90. Implement 90 has four components: a first piece of tubular scrim 92, having a diamond-mesh pattern; a second piece of tubular scrim 94, having a diamond-mesh pattern; a cinching means 96; and a tether not shown, but which is cinched to implement 90 similarly to tether 56 of implement 50. In this embodiment a cut length of about 11 feet (335 cm) of about 1 inch (2.5 cm) diameter, hydrophobic polyethylene, diamond-mesh tubular scrim 92 is transversely stretched and gathered on a mandrel to form circumferential pleats 98. While gathered on the mandrel, tubular scrim 92 is placed in an oven to heat set the piece of tubular scrim in a pleated and expanded condition. When the first piece of scrim 92 is removed from the mandrel and the oven, it does not contract transversely or expand axially. It is instead a hollow pleated cylinder of expanded diamond-mesh scrim. In this condition first piece of scrim 92 forms a three-dimensional structure which provides the bulk of implement 90.

First piece of expanded scrim tubing 92 is then extended longitudinally and uniformly folded into a stack of layers. Although there is no structural reason for pleating first piece of scrim tubing 92 if it is later to be folded, less space is required on a mandrel when the tubing is gathered. A smaller mandrel can be used. A smaller mandrel permits use of a correspondingly smaller oven. Alternatively, pleats 98 could be avoided if scrim tubing 92 were received at assembly as pre-stretched and heat set material from a supplier.

Second piece of tubular scrim 94 is also preferably cut from the same source as first piece 92, but it is not heat set. It is cut to a length of about 14 inches (36 cm), and is inserted between the centermost folds of the folded first piece of tubular scrim 92. One end of second piece 94 is stretched and inverted around folded first piece 92 and then gathered at the opposite end of first piece 92 overlapping the other end of second piece 94, and thereby enveloping first piece 92 in a diamond-mesh scrim bag to form ball-like implement 90. The two ends of second piece of tubular scrim 94 are cinched together as a means for confining first piece of tubular scrim 92 within the bag. Then about 5 inches (13 cm) of cinched piece of tubular scrim 94 is trimmed off the bag near the cinch point to minimize the volume of cinched material.

The cinching means 96 is preferably a hydrophobic band of material which has an interlocking surface 100 and a means 102 for engaging the interlocking surface. When band 96 is pulled tightly around overlapping ends of second piece 94, the means 102 for engaging the interlocking surface 100 prevents band 96 from loosening. Such bands are commonly used to bundle electrical wiring.

Figure 16:
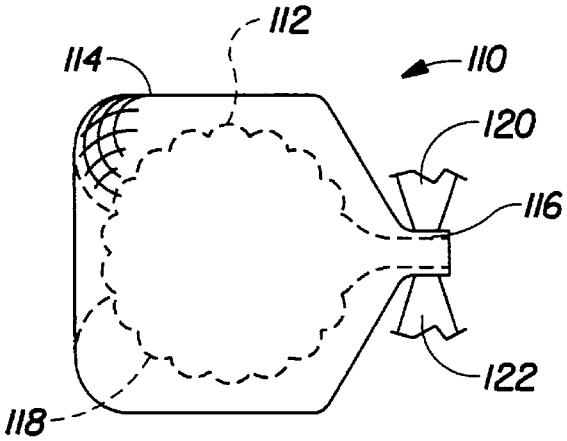
FIG. 16 is a front elevation view of another preferred embodiment of the present invention, disclosing an implement similar to that of FIG. 7, except that the first piece of scrim is randomly crumpled into a ball rather than pleated, and the ends of the second piece of tubular scrim are cinched by a pair of thermobonding dies.
Figure 17:
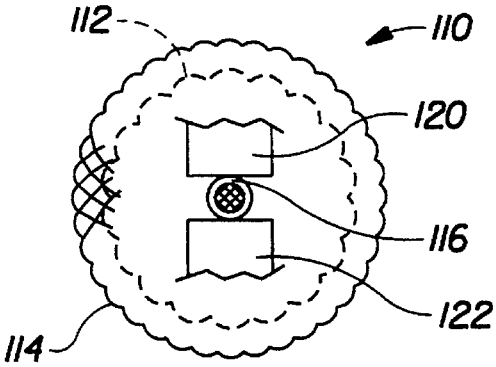
FIG. 17 is a right side elevation view thereof, showing the second piece of tubular scrim passing through the randomly crumpled ball of scrim, as well as around the three-dimensional crumpled structure.

FIGS. 16 and 17 show another preferred embodiment of the present invention which provides a personal cleansing implement, which is generally indicated as 110. Implement 110 has four components: a first piece of tubular scrim 112, having a diamond-mesh pattern; a second piece of tubular scrim 114, having a diamond-mesh pattern; a cinching means 116; and a tether not shown, but which is similar to tether 56 of implement 50. In this embodiment a cut length of about 11 feet (335 cm) of about 1 inch (2.5 cm) diameter, hydrophobic polyethylene, diamond-mesh tubular scrim 112 is transversely stretched and gathered on a mandrel to form circumferential pleats 118. While gathered on the mandrel, tubular scrim 112 is placed in an oven to heat set the piece of tubular scrim in a pleated and expanded condition. When the first piece of scrim 112 is removed from the mandrel and the oven, it does not contract transversely or expand axially. It is instead a hollow pleated cylinder of expanded diamond-mesh scrim. In this condition first piece of scrim 112 forms a three-dimensional structure which provides the bulk of implement 110.

First piece of expanded scrim tubing 112 is then extended longitudinally and randomly crumpled into a ball. Although there is no structural reason for pleating first piece of scrim tubing 112 if it is later to be crumpled, less space is required on a mandrel when the tubing is gathered. A smaller mandrel can be used. A smaller mandrel permits use of a correspondingly smaller oven. Alternatively, pleats 118 could be avoided if scrim tubing 112 were received at assembly as pre-stretched and heat set material from a supplier.

Second piece of tubular scrim 114 is also preferably cut from the same source as first piece 112, but it is not heat set. It is cut to a length of about 14 inches (36 cm), and is inserted between randomly crumpled layers of first piece of tubular scrim 112. One end of second piece 114 is stretched and inverted around crumpled first piece 112 and then gathered at the opposite end of first piece 112, overlapping the other end of second piece 114, and thereby enveloping first piece 112 in a diamond-mesh scrim bag to form ball-like implement 110. The two ends of second piece of tubular scrim 114 are cinched together in order to confine first piece of tubular scrim 112 within the bag. Then about 5 inches (13 cm) of cinched piece of tubular scrim 114 is trimmed off the bag near the cinch point to minimize the volume of cinched material. The cinching means is preferably a thermobond, which is made by heated sealing jaws 120 and 122. Such thermobonding is commonly known in the polymer film art.

Another means for containing the three-dimensional structures disclosed herein, which is contempleated by the present invention, is a piece of scrim tubing into which a three-dimensional structure is placed. The scrim tubing ends are cinched at both ends to envelop the three-dimensional structure. Having two cinch points is considered less attractive than having a single cinch point, from a performance standpoint, but such construction may have manufacturing advantages.

With any of the containing means disclosed herein, it may be beneficial for such means to be made from a different scrim material than that of the three-dimensional structure. The purpose would be to provide a softer feeling, skin contacting, implement surface. Alternatively, the containing scrim material could be the same as that of the three-dimensional structure, but it could be processed differently in order to provide a softer tactile sensation when rubbed against one's skin.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A personal cleansing implement comprising:

a) a first piece of tubular extruded plastic scrim having a longitudinal axis, said first piece of tubular scrim being expanded transversely to said longitudinal axis and gathered parallel to said longitudinal axis, forming circumferential pleats, said first piece of tubular scrim having an elongated center opening and an outer surface; and b) an elongated second piece of tubular scrim passing through said center opening in said first piece of tubular scrim, said second piece of tubular scrim having a first end and a second end, said first end of said second piece of tubular scrim being stretched around said pleats until said second piece of tubular scrim is fully inverted over said outer surface of said first piece of tubular scrim, said first end of said second piece of tubular scrim being cinched to said second end of said second piece of tubular scrim such that said second piece of tubular scrim envelops said first piece of tubular scrim, said second piece of tubular scrim confining said circumferential pleats from axial expansion.

2. A personal cleansing implement comprising:

a) expanded diamond-mesh scrim tubing forming a three-dimensional structure, said tubing gathered to form circumferential pleats, said three-dimensional structure having an outer surface and a center opening there-through, b) means for containing said three-dimensional structure, said containing means having a first end and a second end, said containing means passing through said opening in said three-dimensional structure and around said outer surface such that said containing means totally envelops said three-dimensional structure, said first end being cinched to said second end by a cinching means to close said containing means.

3. The personal cleansing implement of claim 2 wherein said containing means comprises a piece of diamond-mesh tubular scrim.

4. The personal cleansing implement of claim 2 wherein said cinching means comprises a band of hydrophobic material, said band having an interlocking surface and a means for engaging said interlocking surface so that when said band is pulled tightly around material to be cinched, said means for engaging said interlocking surface engages said interlocking surface and prevents said band from loosening.

5. The personal cleansing implement of claim 2 wherein said cinching means comprises thermobonding.

6. The personal cleansing implement of claim 2 wherein said diamond-mesh scrim, said containing means, and said cinching means are made of hydrophobic materials.

7. The personal cleansing implement of claim 2 further comprising means for hanging said personal cleansing implement, said hanging means connected to said cinching means.

* * * * *